US010068752B2

(12) United States Patent
Baba

(10) Patent No.: US 10,068,752 B2
(45) Date of Patent: Sep. 4, 2018

(54) MULTIPLEXED PRECURSOR ISOLATION FOR MASS SPECTROMETRY

(71) Applicant: DH Technologies Development Pte. Ltd., Singapore (SG)

(72) Inventor: Takashi Baba, Richmond Hill (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 15/026,235

(22) PCT Filed: Oct. 7, 2014

(86) PCT No.: PCT/IB2014/002040

§ 371 (c)(1),
(2) Date: Mar. 30, 2016

(87) PCT Pub. No.: WO2015/056067

PCT Pub. Date: Apr. 23, 2015

(65) Prior Publication Data

US 2016/0217991 A1 Jul. 28, 2016

Related U.S. Application Data

(60) Provisional application No. 61/891,579, filed on Oct. 16, 2013.

(51) Int. Cl.
*H01J 49/04* (2006.01)
*H01J 49/00* (2006.01)
(Continued)

(52) U.S. Cl.
CPC ..... *H01J 49/0036* (2013.01); *H01J 49/004* (2013.01); *H01J 49/0031* (2013.01);
(Continued)

(58) Field of Classification Search
USPC ..... 250/304
See application file for complete search history.

(56) References Cited

U.S. PATENT DOCUMENTS 6,570,153 B1 * 5/2003 Li ..... H01J 49/0081 250/282
8,426,804 B2 * 4/2013 Badiei ..... H01J 49/005 250/281

(Continued)

OTHER PUBLICATIONS

International Search Report and Written Opinion for PCT/IB2014/002040, dated Jan. 29, 2015.

*Primary Examiner* — Phillip A Johnston
(74) *Attorney, Agent, or Firm* — John R. Kasha; Kelly L. Kasha; Kasha Law LLC

(57) ABSTRACT

Systems and methods for multiplexed precursor ion selection are provided. A mass isolator includes a selection region of rods, a transmission region of rods, and a barrier electrode lens separating the selection and transmission regions. Two or more different precursor ions are selected by applying two or more different AC voltage frequencies to rods of a selection region in order to resonate the two or more different precursor ions from a continuous beam of ions. The two or more different precursor ions are transmitted by applying a DC voltage to the barrier electrode lens, creating an electric field potential barrier over which only the resonating ions are transmitted. Precursor ions of product ions from combined product ion spectra produced by multiplexed precursor ion selection are identified by grouping the target precursor ions.

18 Claims, 11 Drawing Sheets

(51) Int. Cl.
*H01J 49/06* (2006.01)
*H01J 49/42* (2006.01)

(52) U.S. Cl.
CPC ..... *H01J 49/04* (2013.01); *H01J 49/067* (2013.01); *H01J 49/4285* (2013.01)

(56) References Cited

U.S. PATENT DOCUMENTS

| | | | | |
|---|---|---|---|---|
| 2009/0101810 | A1 | 4/2009 | McClean et al. | |
| 2009/0261247 | A1 | 10/2009 | Cooks et al. | |
| 2010/0237236 | A1* | 9/2010 | Thomson | H01J 49/0045 250/283 |
| 2011/0049358 | A1 | 3/2011 | Green et al. | |
| 2012/0193526 | A1* | 8/2012 | Kovtoun | H01J 49/005 250/282 |
| 2013/0068942 | A1 | 3/2013 | Verenchikov | |

* cited by examiner

100

600

800

MULTIPLEXED PRECURSOR ISOLATION FOR MASS SPECTROMETRY

CROSS REFERENCE TO RELATED APPLICATION

This application claims the benefit of U.S. Provisional Patent Application Ser. No. 61/891,579, filed Oct. 16, 2013, the content of which is incorporated by reference herein in its entirety.

INTRODUCTION

High throughput quantitative mass spectrometry analysis (MS) is generally performed using multiple reaction monitoring (MRM) on a quadrupole filtering instrument. Conventionally, target precursor ions are isolated and fragmented separately. This serial analysis of multiple precursor ions leads to a tradeoff between the overall duty cycle of the data collection process and the signal-to-noise ratio (S/N) of the quantitative data that is collected.

For example, in order to achieve a certain S/N of the quantitative data collected, the analysis time of each target precursor ion of N target precursor ions is increased by $\Delta t$. This, in turn, increases the overall duty cycle of the data collection process by $N \times \Delta t$. Similarly, in order to collect quantitative data for N target precursor ions across a narrow liquid chromatography (LC) peak, for example, the analysis time of each target precursor ion can be decreased. As a result, the S/N of the quantitative data collected for each target precursor ion is reduced.

SUMMARY

A system is disclosed for multiplexed precursor ion selection and transmission using an electrical field potential barrier. The system includes an ion source, a mass isolator, and a processor.

The ion source provides a continuous beam of ions. The mass isolator includes a selection region of rods, a transmission region of rods, and a barrier electrode lens separating the selection region and the transmission region. The mass isolator receives the continuous ion beam from the ion source.

The processor selects two or more different precursor ions by applying two or more different alternating current (AC) voltage frequencies to the rods of the selection region in order to resonate the two or more different precursor ions from the beam of ions in the selection region. The processor transmits the two or more different precursor ions from the selection region to the transmission region by applying a direct current (DC) voltage to the barrier electrode lens relative to the rods of the selection region and rods of the transmission region in order to create an electric field potential barrier over which only the resonating two or more different precursor ions are transmitted.

A method is disclosed for multiplexed precursor ion selection and transmission using an electrical field potential barrier. Two or more different precursor ions are selected by applying two or more different AC voltage frequencies to rods of a selection region of a mass isolator in order to resonate the two or more different precursor ions from a continuous beam of ions in the selection region using a processor. The mass isolator includes the selection region of rods, a transmission region of rods, and a barrier electrode lens separating the selection region and the transmission region. The mass isolator receives the continuous ion beam from an ion source.

The two or more different precursor ions are transmitted from the selection region to the transmission region by applying a DC voltage to the barrier electrode lens relative to the rods of the selection region and rods of the transmission region in order to create an electric field potential barrier over which only the resonating two or more different precursor ions are transmitted using the processor.

A computer program product is disclosed that includes a non-transitory and tangible computer-readable storage medium whose contents include a program with instructions being executed on a processor so as to perform a method for multiplexed precursor ion selection and transmission using an electrical field potential barrier. The method includes providing a system, wherein the system comprises one or more distinct software modules, and wherein the distinct software modules comprise a control module.

The control module selects two or more different precursor ions by applying two or more different AC voltage frequencies to rods of a selection region of a mass isolator in order to resonate the two or more different precursor ions from a continuous beam of ions in the selection region. The mass isolator includes the selection region of rods, a transmission region of rods, and a barrier electrode lens separating the selection region and the transmission region. The mass isolator receives the continuous ion beam from an ion source.

The control module transmits the two or more different precursor ions from the selection region to the transmission region by applying a DC voltage to the barrier electrode lens relative to the rods of the selection region and rods of the transmission region in order to create an electric field potential barrier over which only the resonating two or more different precursor ions are transmitted.

A system is disclosed for identifying precursor ions of product ions from combined product ion spectra produced by a tandem mass spectrometer that performs multiplexed precursor ion selection. The system includes an ion source, a tandem mass spectrometer, and a processor.

The ion source provides a continuous beam of ions. The tandem mass spectrometer includes a mass filter that performs multiplexed precursor ion selection. The processor selects N precursor ions, and creates N groups of the N precursor ions. Each of the N groups has N−1 precursor ions of the N precursor ions. A different precursor ion of the N precursor ions is not included in each of the N groups.

The processor instructs the tandem mass spectrometer to perform multiplexed precursor ion selection on the continuous beam of ions each for the N groups, fragment each of the N−1 precursor ions selected in each of the N groups, and measure the intensities of the product ions produced by each of the N groups, producing N product ion spectra.

The processor plots a heat map for each of the N product ion spectra, producing N heat maps. The processor combines the N product ion spectra into a combined product ion spectrum. The processor identifies a corresponding precursor ion of a peak in the combined product ion spectrum by finding a heat map of the N heat maps that does not have data for the mass of the peak and determining that a precursor ion of the N precursor ions that is not included in a group that produced the heat map is the corresponding precursor ion.

A method is disclosed for identifying precursor ions of product ions from combined product ion spectra produced by a tandem mass spectrometer that performs multiplexed precursor ion selection. N precursor ions are selected using a processor. N groups of the N precursor ions are created using the processor. Each of the N groups has N−1 precursor ions of the N precursor ions. A different precursor ion of the N precursor ions is not included in each of the N groups.

A tandem mass spectrometer is instructed, using the processor, to perform multiplexed precursor ion selection on a continuous beam of ions provided by an ion source for each of the N groups, fragment each of the N−1 precursor ions selected in each of the N groups, and measure the intensities of the product ions produced by each of the N groups, producing N product ion spectra. A heat map for each of the N product ion spectra is plotted using the processor, producing N heat maps. The N product ion spectra are combined into a combined product ion spectrum using the processor.

A corresponding precursor ion of a peak is identified in the combined product ion spectrum by finding a heat map of the N heat maps that does not have data for the mass of the peak and determining that a precursor ion of the N precursor ions that is not included in a group that produced the heat map is the corresponding precursor ion using the processor.

A computer program product is disclosed that includes a non-transitory and tangible computer-readable storage medium whose contents include a program with instructions being executed on a processor so as to perform a method for identifying precursor ions of product ions from combined product ion spectra produced by a tandem mass spectrometer that performs multiplexed precursor ion selection.

In various embodiments, the method includes providing a system, wherein the system comprises one or more distinct software modules, and wherein the distinct software modules comprise a control module and an identification module. The control module selects N precursor ions. The control module creates N groups of the N precursor ions. Each of the N groups has N−1 precursor ions of the N precursor ions. A different precursor ion of the N precursor ions is not included in each of the N groups. The control module instructs a tandem mass spectrometer to perform multiplexed precursor ion selection on a continuous beam of ions provided by an ion source for each of the N groups, fragment each of the N−1 precursor ions selected in each of the N groups, and measure the intensities of the product ions produced by each of the N groups, producing N product ion spectra.

The identification module plots a heat map for each of the N product ion spectra, producing N heat maps. The identification module combines the N product ion spectra into a combined product ion spectrum. The identification module identifies a corresponding precursor ion of a peak in the combined product ion spectrum by finding a heat map of the N heat maps that does not have data for the mass of the peak and determining that a precursor ion of the N precursor ions that is not included in a group that produced the heat map is the corresponding precursor ion.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
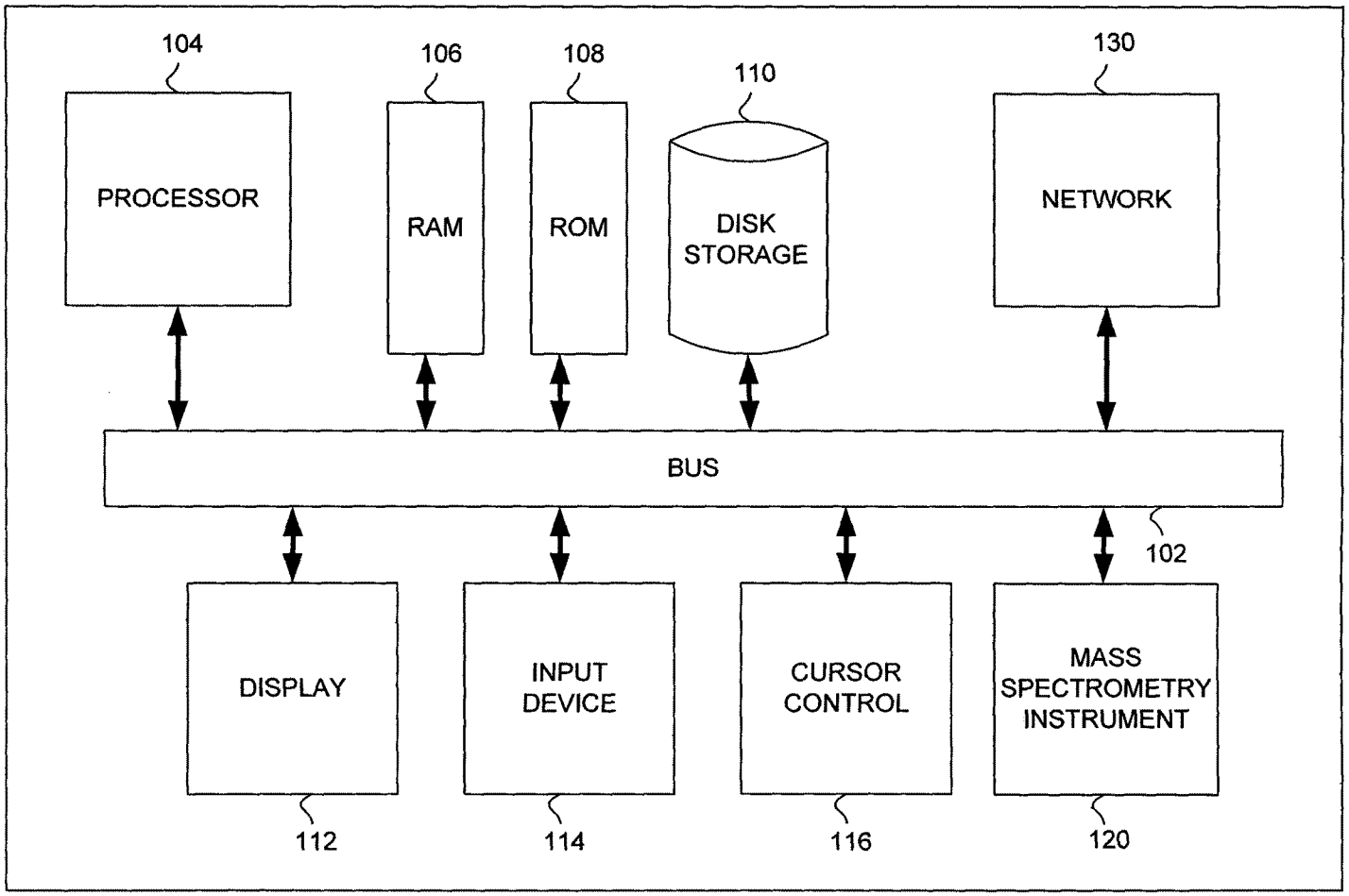
FIG. 1 is a block diagram that illustrates a computer system, upon which embodiments of the present teachings may be implemented.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

Computer system 100 can be used, for example, to send and receive control signals and/or data to and/or from a mass spectrometry instrument 120. Mass spectrometry instrument 120 can be connected to computer system 100 through bus 102 or can be connected to computer system 100 through a network 130, for example.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Multiplex Isolation Using a Potential Barrier

As described above, conventional serial isolation of multiple target precursor ions in multiple reaction monitoring (MRM) leads to a tradeoff between the overall duty cycle of the data collection process and the signal-to-noise ratio (S/N) of the quantitative data that is collected. Essentially, any improvement in the overall duty cycle of the data collection process reduces the SN of the quantitative data that is collected, and any improvement in the S/N of the quantitative data adversely affects the overall duty cycle of the data collection process.

In various embodiments, multiplexed precursor ion isolation allows improvement in the overall duty cycle of the data collection process without a reduction in the S/N of the quantitative data that is collected. Or, multiplexed precursor ion isolation allows an improvement in the S/N of the quantitative data without adversely affecting the overall duty cycle of the data collection process. In other words, multiplexed precursor ion isolation is used to eliminate the tradeoff between the overall duty cycle of the data collection process and the S/N of the quantitative data that is collected.

Essentially, multiplexed precursor ion isolation involves selecting and transmitting two or more target precursor ions in the same time period. Multiplexed precursor ion isolation can be performed using flow through instruments, such as quadrupoles, or can be performed using non-flow through instruments, such as ion trap instruments. By using flow through instruments, there is no time penalty for selecting or isolating two or more target precursor ions at the same time.

Potential Barrier System

Figure 2:
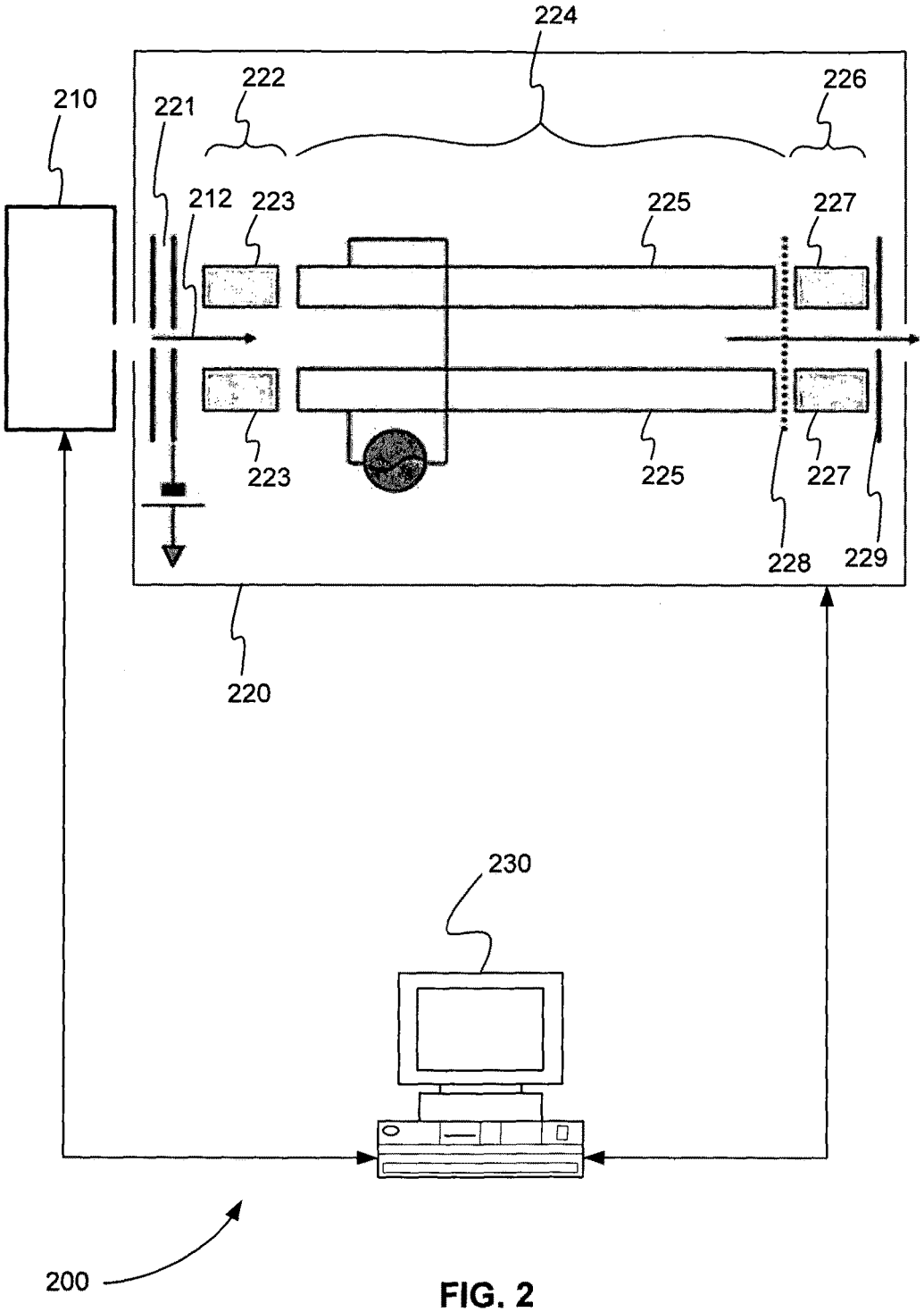
FIG. 2 is a schematic diagram of a system for multiplexed precursor ion selection and transmission using an electrical field potential barrier, in accordance with various embodiments.

FIG. 2 is a schematic diagram of a system 200 for multiplexed precursor ion selection and transmission using an electrical field potential barrier, in accordance with various embodiments. System 200 includes ion source 210, mass isolator or mass filter 220, and processor 230.

Ion source 210 provides a continuous beam of ions 212 to mass isolator 220. Mass isolator 220 includes selection region 224 of rods 225 and transmission region 226 of rods 227. Mass isolator 220 also includes barrier electrode lens 228 separating selection region 224 and transmission region 226.

Processor 230 can be, but is not limited to, a computer, microprocessor, or any device capable of sending and receiving control signals and data to and from ion source 210 and mass isolator 220. Processor 230 is in communication with ion source 210 and mass isolator 220.

Processor 230 selects two or more different precursor ions by applying two or more different alternating current (AC) voltage frequencies to rods 225 of selection region 224. The voltage frequencies resonate the two or more different precursor ions from the beam of ions in selection region 224.

Processor 230 transmits the two or more different precursor ions from selection region 224 to transmission region 226 by applying a direct current (DC) voltage to barrier electrode lens 228 relative to rods 225 of selection region 224 and rods 227 of transmission region 226 in order to create an electric field potential barrier over which only the resonating two or more different precursor ions are transmitted. Transmission region 226 is shorter in length than selection region 224, for example.

Figure 3:
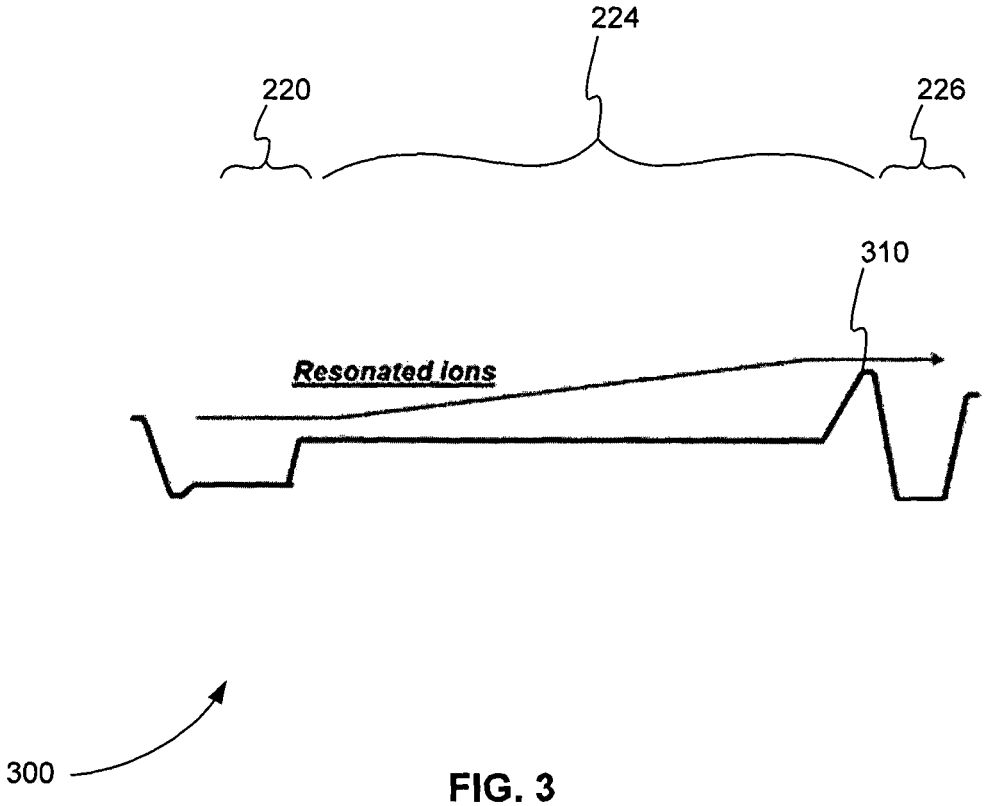
FIG. 3 is an exemplary plot of the direct current (DC) voltage applied across the quadrupole of FIG. 2 showing the path of resonated precursor ions in response to the DC voltage, in accordance with various embodiments.

FIG. 3 is an exemplary plot 300 of the direct current (DC) voltage applied across quadrupole 220 of FIG. 2 showing the path of resonated precursor ions in response to the DC voltage, in accordance with various embodiments. The DC voltage applied to barrier electrode lens 228 relative to rods 225 of selection region 224 and rods 227 of transmission region 226 shown in FIG. 2 produces electric field potential barrier 310 shown in FIG. 3. Only the resonating two or more different precursor ions are transmitted over electric field potential barrier 310, because the DC bias on barrier electrode lens 228 of FIG. 2 selects an ion's kinetic energy that is given by the resonant excitation.

Returning to FIG. 2, in various embodiments, barrier electrode lens 228 is a mesh electrode or lens. Barrier electrode lens 228 is meshed to avoid transmission region 226 field penetration through the hole in barrier electrode lens 228, which would change the electric field potential at barrier electrode lens 228, for example. Another exemplary reason for using a mesh electrode rather than a solid electrode for barrier electrode lens 228 is that the vacuum pressure in transmission region 226 should be as low as selection region 224. Otherwise, ions are pushed back by gas flow from a fragmentation device (not shown) positioned after transmission region 226 to selection region 224. A fragmentation device can include, but is not limited to, a collision cell.

In various embodiments, mass isolator 220 further includes double sided ion beam electrode lens 221 and ion beam transmission region 222 of rods 223 positioned before selection region 224. Processor 230 applies a DC voltage to a side of double sided ion beam electrode lens 221 relative to rods 223 of ion beam transmission region 222 and rods 225 of selection region 224 so that precursor ions from the beam of ions that are not resonated in selection region 224 are transmitted back to the side of doubled sided ion beam electrode lens 221 and removed from the beam of ions.

Figure 4:
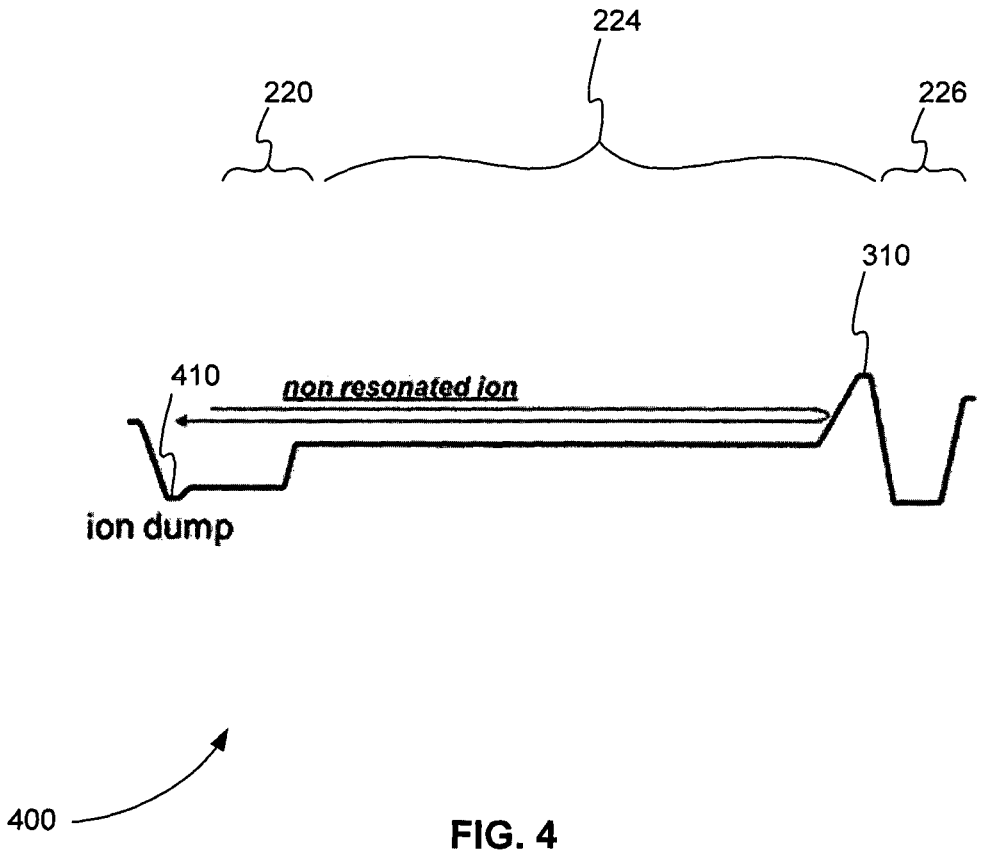
FIG. 4 is an exemplary plot of the DC voltage applied across the quadrupole of FIG. 2 showing the path of non-resonated precursor ions in response to the DC voltage, in accordance with various embodiments.

FIG. 4 is an exemplary plot 400 of the direct current (DC) voltage applied across quadrupole 220 of FIG. 2 showing the path of non-resonated precursor ions in response to the DC voltage, in accordance with various embodiments. The DC voltage applied to a side of double sided ion beam electrode lens 221 relative to rods 223 of ion beam transmission region 222 and rods 225 of selection region 224 of FIG. 2 produces electric field potential well or ion dump 410 shown in FIG. 4. Non-resonated precursor ions are kicked back by electric field potential barrier 310 and return back in the direction of electric field potential well 410 to be removed from the beam of ions by a side of doubled sided ion beam electrode lens 221 shown in FIG. 2.

Returning to FIG. 2, in various embodiments, mass isolator 220 further includes exit electrode lens 229. Exit electrode lens 229, for example, transmits the multiply selected precursor target ions to a fragmentation device (not shown) for fragmentation. In an experiment without transmission region 226 and without exit electrode lens 229, gas flow from selection region 224 to a fragmentation device had a significant loss of ions when the ions were traveling through barrier electrode lens 228, which was a conductance limit of the gas as well as the potential well because the kinetic energy of target ions was nearly zero at barrier electrode lens 228.

In various embodiments, transmission region 226 and exit electrode lens 229 are used to prevent this problem. Transmission region 226 and exit electrode lens 229 are given a lower pressure. In addition, exit electrode lens 229 is biased to be lower than barrier electrode lens 228 to give the target precursor ions more kinetic energy to overcome the gas flow. Exit electrode lens 229 is at the conductance limit, for example. Barrier electrode lens 228 also can be given a large hole, for example, to evacuate transmission region 226.

Target precursor ions transmitted from selection region 224 through barrier electrode lens 228 have a radial oscillation, because these ions are excited by AC fields. This means the two or more different precursor ions selected in selection region 224 have a velocity in the radial direction. This radial oscillation in transmission region 226 can reduce the number of ions transmitted through exit electrode lens 229.

In various embodiments, ion loss due to radial oscillations of the two or more different target precursor ions is reduced by focusing the ions. For example, processor 230 focuses the two or more different precursor ions in transmission region 226 by applying a DC bias voltage to rods 227 of transmission region 226 relative to barrier electrode lens 228 and exit electrode lens 229. The DC bias voltage is set so that translation travel time of the two or more different precursor ions is a multiple of half of the harmonic oscillation period of the radial motion of the two or more different precursor ions due to the AC voltage applied to rods 227 of transmission region 226.

Figure 5:
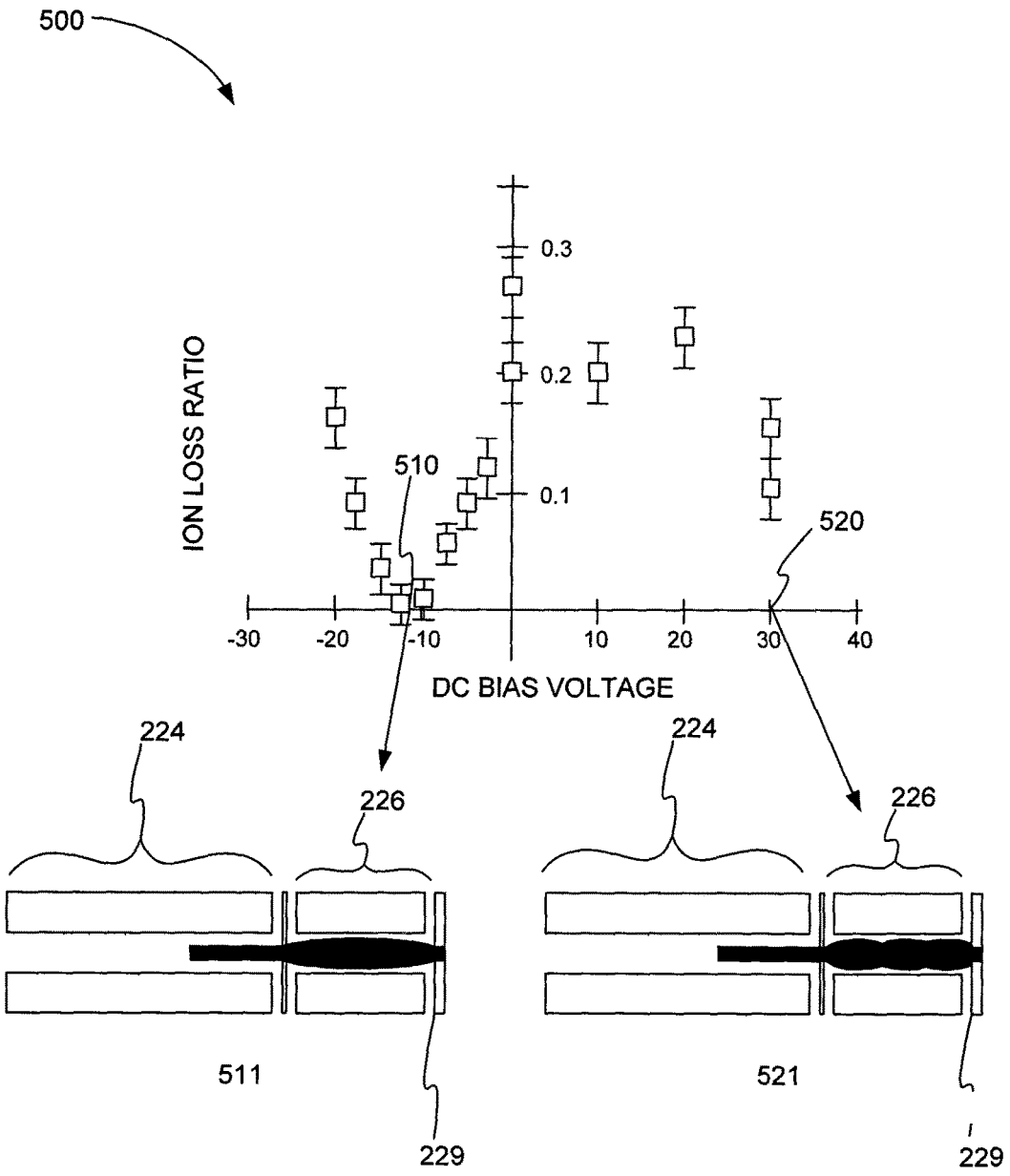
FIG. 5 is an exemplary plot of target precursor ion loss in a transmission region of a quadrupole as a function of DC voltage bias of the rods of the transmission region, in accordance with various embodiments.

FIG. 5 is an exemplary plot 500 of target precursor ion loss in transmission region 226 of a quadrupole as a function of direct current (DC) voltage bias of the rods of transmission region 226, in accordance with various embodiments. Plot 500 shows that there is an optimum DC bias voltage 510 that reduces the target precursor ion loss. Optimum DC bias voltage 510 is, for example, −12.5 V. In plot 500 an exemplary schematic diagram 511 shows the radial motion of the two or more different precursor ions in selection region 224 and transmission region 226 when DC bias voltage 510 is applied. Schematic diagram 511 shows that DC bias voltage 510 focuses a first null zone of the radial motion on exit electrode lens 229.

In plot 500 an exemplary schematic diagram 521 shows the radial motion of the two or more different precursor ions in selection region 224 and transmission region 226 for non-optimum DC bias voltage 520. Non-optimum DC bias voltage 520 is, for example, 30 V. Schematic diagram 521 shows that DC bias voltage 520 does not quite focus a third null zone of the radial motion on exit electrode lens 229. As a result, there is some ion loss.

Potential Barrier Method

Figure 6:
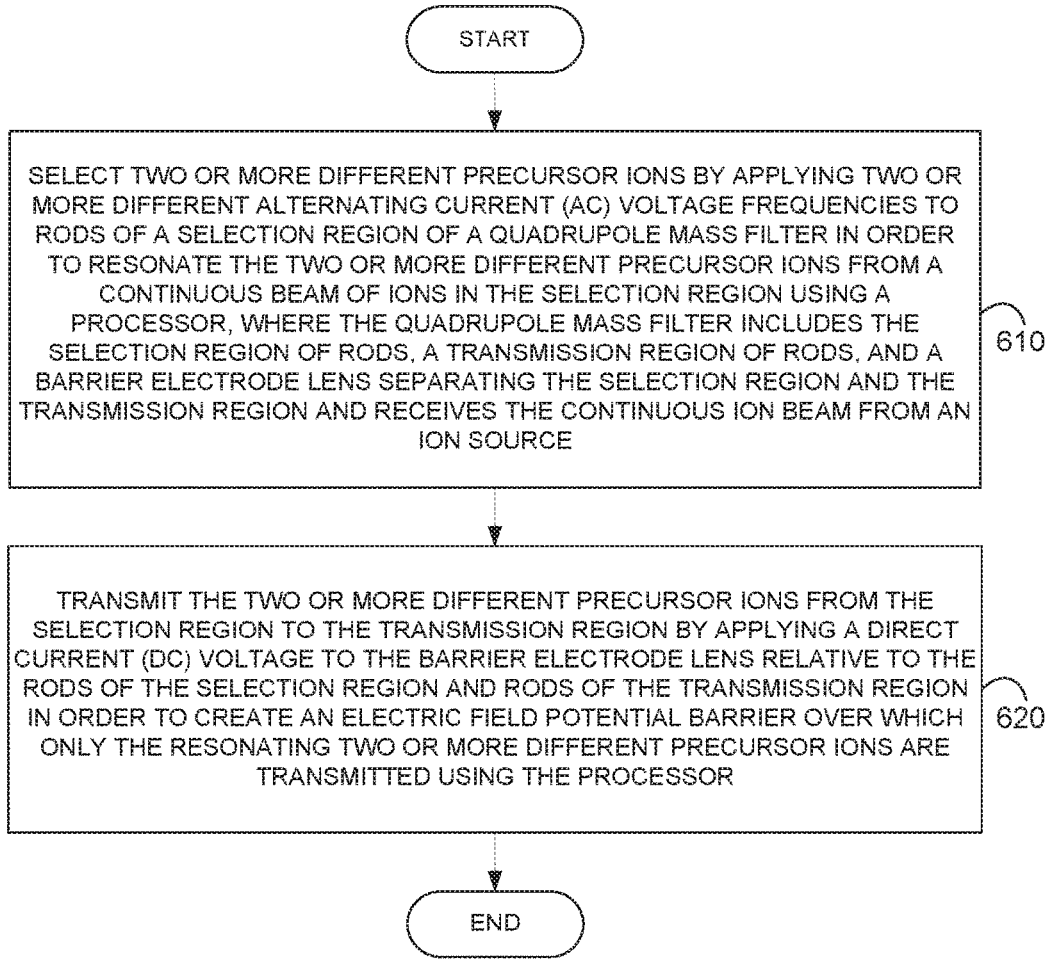
FIG. 6 is a flowchart showing a method for multiplexed precursor ion selection and transmission using an electrical field potential barrier, in accordance with various embodiments.

FIG. 6 is a flowchart showing a method 600 for multiplexed precursor ion selection and transmission using an electrical field potential barrier, in accordance with various embodiments.

In step 610 of method 600, two or more different precursor ions are selected by applying two or more different AC voltage frequencies to rods of a selection region of a mass isolator in order to resonate the two or more different precursor ions from a continuous beam of ions in the selection region using a processor. The mass isolator includes the selection region of rods, a transmission region of rods, and a barrier electrode lens separating the selection region and the transmission region. The mass isolator receives the continuous ion beam from an ion source.

In step 620, the two or more different precursor ions are transmitted from the selection region to the transmission region by applying a DC voltage to the barrier electrode lens relative to the rods of the selection region and rods of the transmission region. This DC voltage creates an electric field potential barrier over which only the resonating two or more different precursor ions are transmitted using the processor.

Potential Barrier Method Computer Program Product

In various embodiments, computer program products include a tangible computer-readable storage medium whose contents include a program with instructions being executed on a processor so as to perform a method for multiplexed precursor ion selection and transmission using an electrical field potential barrier. This method is performed by a system that includes one or more distinct software modules.

Figure 7:
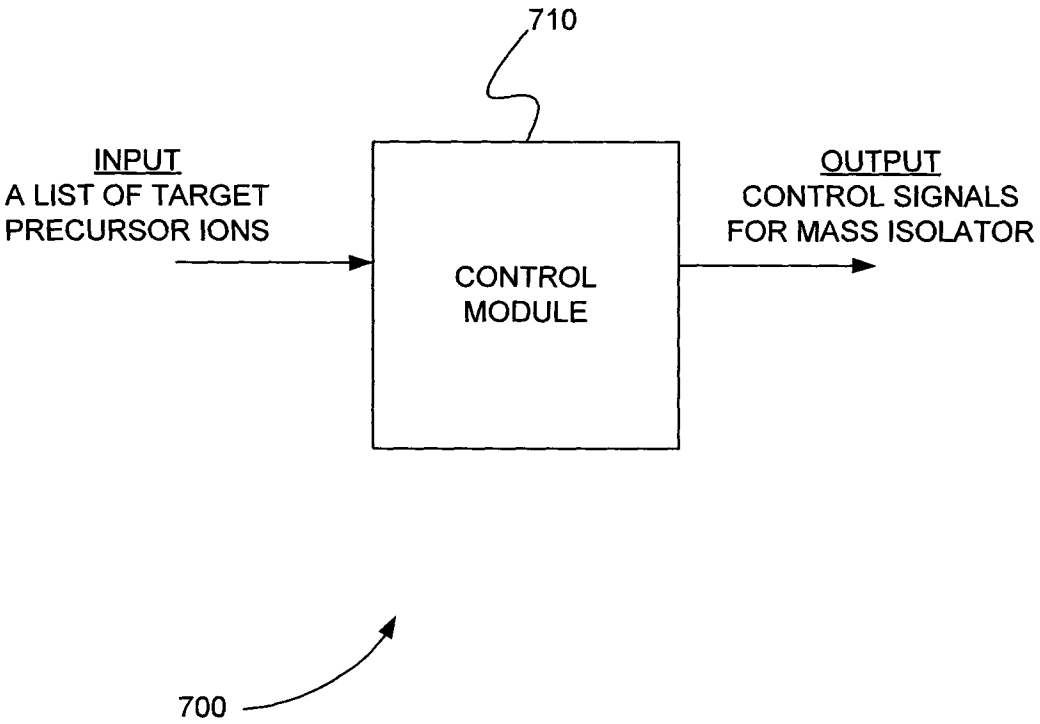
FIG. 7 is a schematic diagram of a system that includes one or more distinct software modules that performs a method for multiplexed precursor ion selection and transmission using an electrical field potential barrier, in accordance with various embodiments.

FIG. 7 is a schematic diagram of a system 700 that includes one or more distinct software modules that performs a method for multiplexed precursor ion selection and transmission using an electrical field potential barrier, in accordance with various embodiments. System 700 includes control module 710.

Input to control module 710 is, for example, a list of target precursor ions. Output from control module 710 is, for example, control signals for a mass isolator. Control module 710 selects two or more different precursor ions by applying two or more different AC voltage frequencies to rods of a selection region of the mass isolator in order to resonate the two or more different precursor ions from a continuous beam of ions in the selection region. The mass isolator includes the selection region of rods, a transmission region of rods, and a barrier electrode lens separating the selection region and the transmission region. The mass isolator receives the continuous ion beam from an ion source.

Control module 710 transmits the two or more different precursor ions from the selection region to the transmission region by applying a DC voltage to the barrier electrode lens relative to the rods of the selection region and rods of the transmission region. This DC voltage creates an electric field potential barrier over which only the resonating two or more different precursor ions are transmitted.

Precursor Identification

When fragmentation or dissociation is applied to multiply isolated precursor ions, the resulting product ion spectrum is a combination of each product ion spectrum of each multiply isolated precursor ion. As a result, identification of the precursor ion for each product ion in the combined spectrum may be-required for qualitative or quantitative analysis in specific applications.

In various embodiments, the precursor ions of product ions from combined product ion spectra produced by multiplexed precursor ion selection can be identified by grouping the target precursor ions. More specifically, a number of groups are created equal to the number of target precursor ions. In each of the created groups one of the target precursor ions is not included. Multiplexed precursor ion selection followed by fragmentation and mass analysis is performed on each of the groups resulting in a product ion spectrum for each group.

Heat maps are then plotted for each product ion spectrum for each group showing if data is present for each product ion mass for each group. The product ion spectra of the groups are then combined into one combined product ion spectrum. By comparing the heat maps to the combined product ion spectrum, groups that do not have data for ion peaks in the combined product ion spectrum are identified.

For example, five target precursor ions (A, B, C, D and E) are selected for qualitative or quantitative analysis. Instead of subjecting all five target precursor ions to multiplexed precursor ion selection, five different groups of the five target precursor ions are selected. These groups are: (B,C,D,E), (A,C,D,E), (A,B,D,E), (A,B,C,E) and (A,B,C,D). Each group does not include one of the five target precursor ions. As a result, these groups can be denoted by the missing precursor ion as −A, −B, −C, −D and −E, respectively. Multiplexed precursor ion selection followed by fragmentation and mass analysis is performed on each of −A, −B, −C, −D and −E, producing five product ion spectra.

Heat maps are plotted for each product ion spectrum for each of the five groups. The five product ion spectra of the groups are then summed into one combined product ion spectrum. All the peaks in the combined product ion spectrum are obtained four times, so the signal intensity in the combined product ion spectrum is four times better than the signal intensity obtained in conventional serial MRM.

Figure 8:
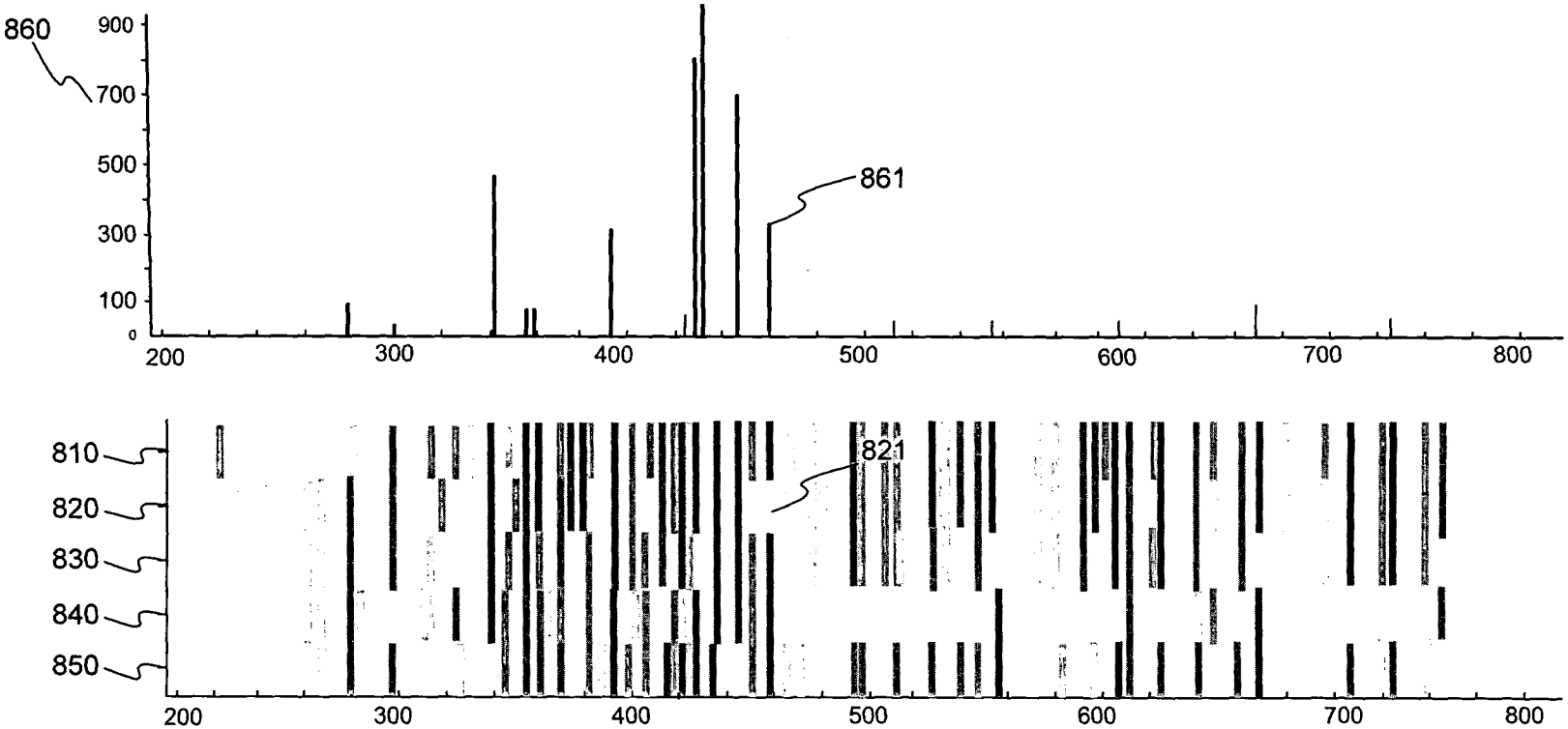
FIG. 8 is an exemplary comparison of heat maps of five groups of target precursor ions with a plot of the combined product ion spectrum of the five groups, in accordance with various embodiments.

FIG. 8 is an exemplary comparison 800 of heat maps 810-850 of five groups of target precursor ions with a plot of the combined product ion spectrum 860 of the five groups, in accordance with various embodiments. Specifically, heat maps 810-850 correspond to groups −A, −B, −C, −D and −E, respectively.

By comparing the five heat maps to the combined product ion spectrum, groups that do not have data for ion peaks in the combined product ion spectrum are identified. For example, peak 861 in combined product ion spectrum 860 has a mass of 459. At mass 459, heat map 820 has missing data at location 821. Missing data implies that peak 861 corresponds to the missing precursor ion of the identified group. Heat map 820 is from group −B. Thus, peak 861 corresponds to the missing precursor ion B. As a result, the precursor ion B of the product ion with peak 861 is identified from the comparison of the five heat maps 810-850 to the combined product ion spectrum 860.

Precursor Identification System

Figure 9:
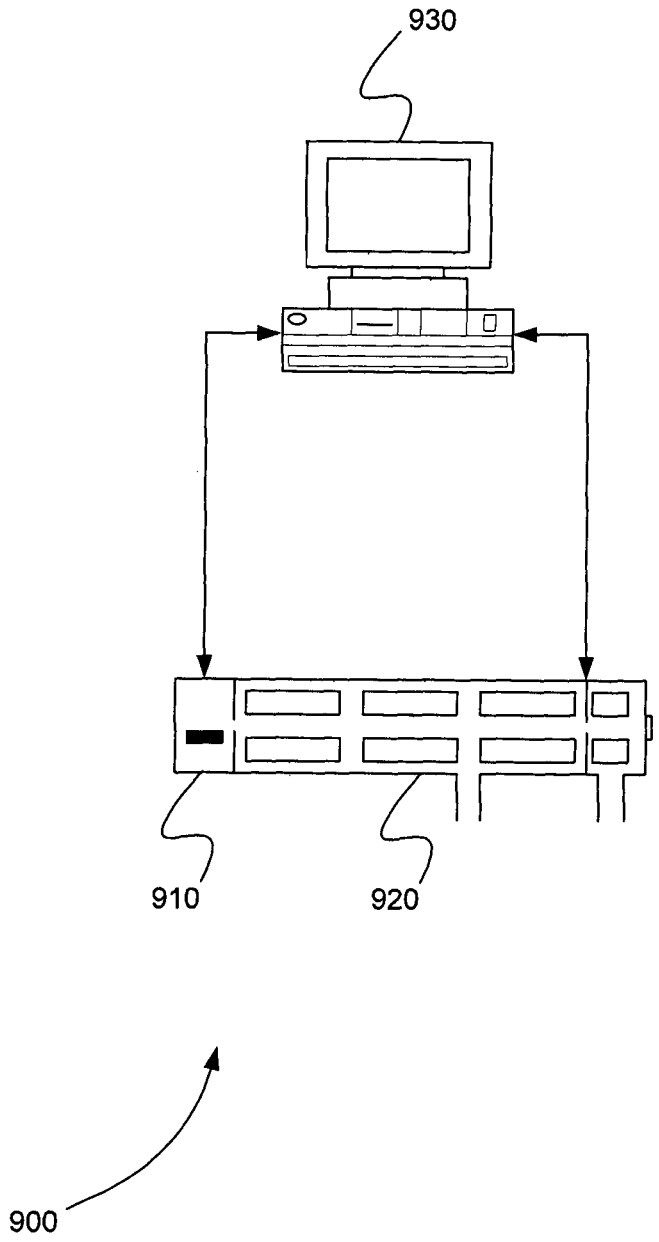
FIG. 9 is schematic diagram of a system for identifying precursor ions of product ions from combined product ion spectra produced by a tandem mass spectrometer that performs multiplexed precursor ion selection, in accordance with various embodiments.

FIG. 9 is schematic diagram of a system 900 for identifying precursor ions of product ions from combined product ion spectra produced by a tandem mass spectrometer that performs multiplexed precursor ion selection, in accordance with various embodiments. System 900 includes ion source 910, tandem mass spectrometer 920, and processor 930. Ion source 910 provides a continuous beam of ions to tandem mass spectrometer 920. Tandem mass spectrometer 920 is shown in FIG. 9 as a triple quadrupole. Tandem mass spectrometer 920 is not limited to a triple quadrupole and can be any type of mass spectrometer.

Tandem mass spectrometer 920 includes a mass filter that performs multiplexed precursor ion selection. Tandem mass spectrometer 920 can include a mass filter such as quadrupole 220 in FIG. 2 that performs multiplexed precursor ion selection using an electric field potential barrier as described above. However, tandem mass spectrometer 920 can include any type of mass filter capable of performing multiplexed precursor ion selection. Further the mass filter of tandem mass spectrometer 920 is not limited to performing multiplexed precursor ion selection using an electric field potential barrier as described above. The mass filter of tandem mass spectrometer 920 can use any method to perform multiplexed precursor ion selection.

Processor 930 can be, but is not limited to, a computer, microprocessor, or any device capable of sending and receiving control signals and data to and from ion source 910 and tandem mass spectrometer 920. Processor 930 is in communication with ion source 910 and tandem mass spectrometer 920.

Processor 930 selects N precursor ions and creates N groups of the N precursor ions. Each of the N groups has N−1 precursor ions of the N precursor ions. A different precursor ion of the N precursor ions is not included in each of the N groups. Processor 930 instructs tandem mass spectrometer 920 to perform multiplexed precursor ion selection on the continuous beam of ions for each of the N groups, fragment each of the N−1 precursor ions selected in each of the N groups, and measure the intensities of the product ions produced by each of the N groups. This produces N product ion spectra.

Processor 930 plots a heat map for each of the N product ion spectra. This produces N heat maps. A heat map typically includes a graphic that indicates the value or intensity of the data at each location or mass, or at each range of locations or range of masses. In various embodiments, the heat map used only includes an indication that a product ion intensity exceeds a certain threshold at a certain mass or range of masses. In other words, the heat map only provides an indication that the product ion spectrum of the group does or does not include a product ion at a certain mass or mass range.

Processor 930 combines the N product ion spectra into a combined product ion spectrum. Processor 930, for example, sums the N product ion spectra to produce a summed product ion spectrum.

Processor 930 identifies a corresponding precursor ion of a peak in the combined product ion spectrum by finding a heat map of the N heat maps that does not have data for the mass of the peak. Processor 930 determines that a precursor ion of the N precursor ions that is not included in a group that produced the heat map is the corresponding precursor ion.

Precursor Identification Method

Figure 10:
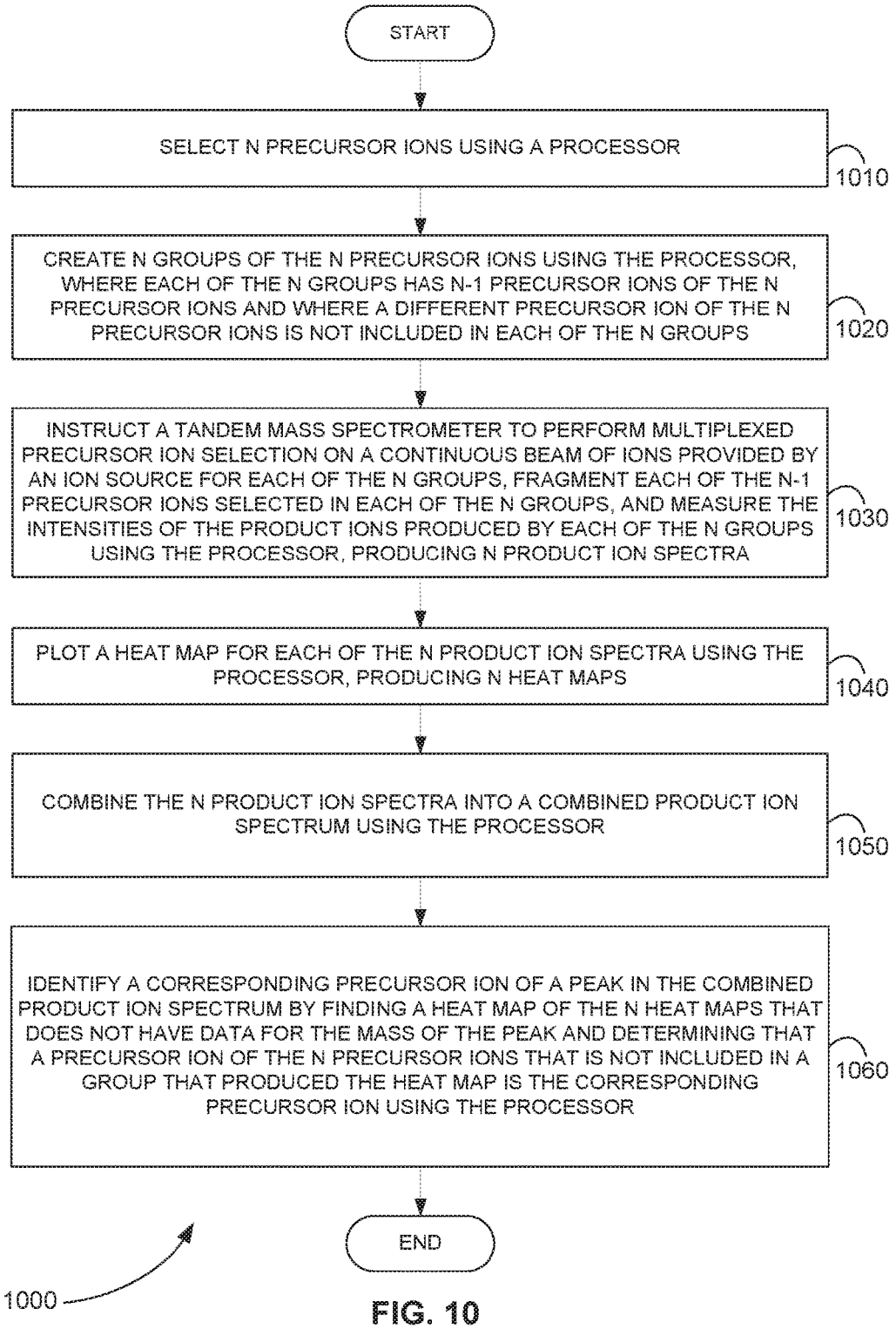
FIG. 10 is a flowchart showing a method for identifying precursor ions of product ions from combined product ion spectra produced by a tandem mass spectrometer that performs multiplexed precursor ion selection, in accordance with various embodiments.

FIG. 10 is a flowchart showing a method 1000 for identifying precursor ions of product ions from combined product ion spectra produced by a tandem mass spectrometer that performs multiplexed precursor ion selection, in accordance with various embodiments.

In step 1010 of method 1000, N precursor ions are selected using a processor.

In step 1020, N groups of the N precursor ions are created using the processor. Each of the N groups has N−1 precursor ions of the N precursor ions, and a different precursor ion of the N precursor ions is not included in each of the N groups.

In step 1030, a tandem mass spectrometer is instructed to perform multiplexed precursor ion selection on a continuous beam of ions provided by an ion source for each of the N groups, fragment each of the N−1 precursor ions selected in each of the N groups, and measure the intensities of the product ions produced by each of the N groups using the processor. This produces N product ion spectra.

In step 1040, a heat map is plotted for each of the N product ion spectra using the processor, producing N heat maps.

In step 1050, the N product ion spectra are combined into a combined product ion spectrum using the processor.

In step 1060, a corresponding precursor ion of a peak in the combined product ion spectrum is identified by finding a heat map of the N heat maps that does not have data for the mass of the peak using the processor. A precursor ion of the N precursor ions that is not included in a group that produced the heat map is the corresponding precursor ion.

Precursor Identification Computer Program Product

In various embodiments, computer program products include a tangible computer-readable storage medium whose contents include a program with instructions being executed on a processor so as to perform a method for identifying precursor ions of product ions from combined product ion spectra produced by a tandem mass spectrometer that performs multiplexed precursor ion selection. This method is performed by a system that includes one or more distinct software modules.

Figure 11:
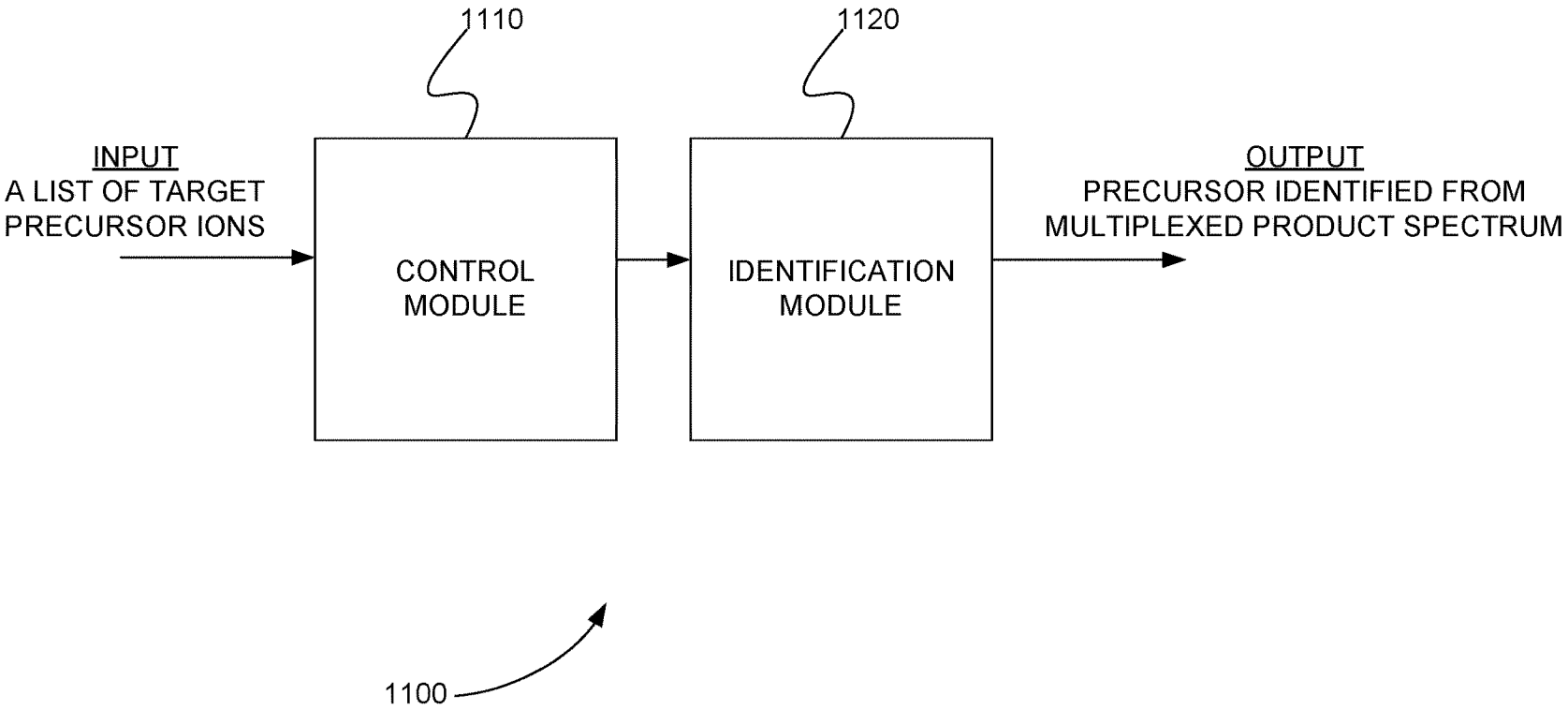
FIG. 11 is a schematic diagram of a system that includes one or more distinct software modules that performs a method for identifying precursor ions of product ions from combined product ion spectra produced by a tandem mass spectrometer that performs multiplexed precursor ion selection, in accordance with various embodiments.

FIG. 11 is a schematic diagram of a system 1100 that includes one or more distinct software modules that performs a method for identifying precursor ions of product ions from combined product ion spectra produced by a tandem mass spectrometer that performs multiplexed precursor ion selection, in accordance with various embodiments. System 1100 includes control module 1110 and identification module 1120.

Input to control module 1110 is, for example, a list of target precursor ions. Control module 1110 selects N precursor ions. Control module 1110 creates N groups of the N precursor ions. Each of the N groups has N−1 precursor ions of the N precursor ions, and a different precursor ion of the N precursor ions is not included in each of the N groups. Control module 1110 instructs a tandem mass spectrometer to perform multiplexed precursor ion selection on a continuous beam of ions provided by an ion source for each of the N groups, fragment each of the N−1 precursor ions selected in each of the N groups, and measure the intensities of the product ions produced by each of the N groups, producing N product ion spectra.

Identification module 1120 plots a heat map for each of the N product ion spectra, producing N heat maps. Identification module 1120 combines the N product ion spectra into a combined product ion spectrum. Identification module 1120 identifies a corresponding precursor ion of a peak in the combined product ion spectrum by finding a heat map of the N heat maps that does not have data for the mass of the peak. A precursor ion of the N precursor ions that is not included in a group that produced the heat map is the corresponding precursor ion. Output from identification module 1120 is, for example, one or more precursor ions identified from a multiplexed product ion spectrum.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for multiplexed precursor ion selection and transmission using an electrical field potential barrier, comprising:

an ion source that provides a continuous beam of ions;

a mass isolator that includes a selection region of rods, a transmission region of rods, a barrier electrode lens separating the selection region and the transmission region, and an exit electrode lens separating the transmission region and a fragmentation device and that receives the continuous ion beam from the ion source; and a processor in communication with the ion source and the mass isolator that selects two or more different precursor ions by applying two or more different alternating current (AC) voltage frequencies only to rods in the selection region in order to resonate the two or more different precursor ions from the beam of ions in the selection region, transmits the resonating two or more different precursor ions from the selection region to the transmission region at the same time by applying a direct current (DC) voltage to the barrier electrode lens, which is positioned between the selection region and the transmission region, relative to the rods in the selection region and rods in the transmission region in order to create an electric field potential barrier over which only the resonating two or more different precursor ions are transmitted, and transmits the two or more different precursor ions from the transmission region to the fragmentation device at the same time by applying a DC voltage to the exit electrode lens that is lower than the DC voltage applied to the barrier electrode lens.

2. The system of claim 1, wherein the barrier electrode lens comprises a mesh electrode or lens.

3. The system of claim 1, wherein the transmission region is shorter in length than the selection region.

4. The system of claim 1, wherein the mass isolator further includes a double sided ion beam electrode lens and an ion beam transmission region of rods positioned before the selection region.

5. The system of claim 4, wherein the processor applies a DC voltage to a side of the double sided ion beam electrode lens relative to the rods of the ion beam transmission region and the rods of the selection region so that precursor ions from the beam of ions that are not resonated in the selection region are transmitted back to the side of the doubled sided ion beam electrode lens and removed from the beam of ions.

6. The system of claim 1, wherein the processor focuses the two or more different precursor ions in the transmission region by applying a DC bias voltage to the rods of the transmission region relative to the barrier electrode lens and the exit electrode lens so that translation travel time of the two or more different precursor ions is a multiple of half of the harmonic oscillation period of the radial motion of the two or more different precursor ions due to the AC voltage applied to the rods of the transmission region.

7. A method for multiplexed precursor ion selection and transmission using an electrical field potential barrier, comprising:

selecting two or more different precursor ions by applying two or more different alternating current (AC) voltage frequencies only to rods in a selection region of a mass isolator in order to resonate the two or more different precursor ions from a continuous beam of ions in the selection region using a processor, wherein the mass isolator includes the selection region of rods, a transmission region of rods, a barrier electrode lens separating the selection region and the transmission region, and an exit electrode lens separating the transmission region and a fragmentation device and receives the continuous ion beam from an ion source, transmitting the resonating two or more different precursor ions from the selection region to the transmission region at the same time by applying a direct current (DC) voltage to the barrier electrode lens, which is positioned between the selection region and the transmission region, relative to the rods in the selection region and rods in the transmission region in order to create an electric field potential barrier over which only the resonating two or more different precursor ions are transmitted using the processor, and transmitting the two or more different precursor ions from the transmission region to the fragmentation device at the same time by applying a DC voltage to the exit electrode lens that is lower than the DC voltage applied to the barrier electrode lens using the processor.

8. The method of claim 7, wherein the barrier electrode lens comprises a mesh electrode or lens.

9. The method of claim 7, wherein the transmission region is shorter in length than the selection region.

10. The method of claim 7, wherein the mass isolator further includes a double sided ion beam electrode lens and an ion beam transmission region of rods positioned before the selection region.

11. The method of claim 10, further comprising applying a DC voltage to a side of the double sided ion beam electrode lens relative to the rods of the ion beam transmission region and the rods of the selection region so that precursor ions from the beam of ions that are not resonated in the selection region are transmitted back to the side of the doubled sided ion beam electrode lens and removed from the beam of ions using the processor.

12. The method of claim 7, further comprising focusing the two or more different precursor ions in the transmission region by applying a DC bias voltage to the rods of the transmission region relative to the barrier electrode lens and the exit electrode lens so that translation travel time of the two or more different precursor ions is a multiple of half of the harmonic oscillation period of the radial motion of the two or more different precursor ions due to the AC voltage applied to the rods of the transmission region using the processor.

13. A computer program product, comprising a non-transitory and tangible computer-readable storage medium whose contents include a program with instructions being executed on a processor so as to perform a method for multiplexed precursor ion selection and transmission using an electrical field potential barrier, comprising:

providing a system, wherein the system comprises one or more distinct software modules, and wherein the distinct software modules comprise a control module;

selecting two or more different precursor ions by applying two or more different alternating current (AC) voltage frequencies only to rods in a selection region of a mass isolator in order to resonate the two or more different precursor ions from a continuous beam of ions in the selection region using the control module, wherein the mass isolator includes the selection region of rods, a transmission region of rods, a barrier electrode lens separating the selection region, and an exit electrode lens separating the transmission region and a fragmentation device and the transmission region and receives the continuous ion beam from an ion source, transmitting the resonating two or more different precursor ions from the selection region to the transmission region at the same time by applying a direct current (DC) voltage to the barrier electrode lens, which is positioned between the selection region and the transmission region, relative to the rods in the selection region and rods in the transmission region in order to create an electric field potential barrier over which only the resonating two or more different precursor ions are transmitted using the control module, and transmitting the two or more different precursor ions from the transmission region to the fragmentation device at the same time by applying a DC voltage to the exit electrode lens that is lower than the DC voltage applied to the barrier electrode lens using the control module.

14. The computer program product of claim 13, wherein the barrier electrode lens comprises a mesh electrode or lens.

15. The computer program product of claim 13, wherein the transmission region is shorter in length than the selection region.

16. The computer program product of claim 13, wherein the mass isolator further includes a double sided ion beam electrode lens and an ion beam transmission region of rods positioned before the selection region.

17. The computer program product of claim 16, further comprising applying a DC voltage to a side of the double sided ion beam electrode lens relative to the rods of the ion beam transmission region and the rods of the selection region so that precursor ions from the beam of ions that are not resonated in the selection region are transmitted back to the side of the doubled sided ion beam electrode lens and removed from the beam of ions using the processor.

18. The computer program product of claim 13, further comprising focusing the two or more different precursor ions in the transmission region by applying a DC bias voltage to the rods of the transmission region relative to the barrier electrode lens and the exit electrode lens so that translation travel time of the two or more different precursor ions is a multiple of half of the harmonic oscillation period of the radial motion of the two or more different precursor ions due to the AC voltage applied to the rods of the transmission region using the processor.

* * * * *